US006739410B2

(12) United States Patent
Smith et al.

(10) Patent No.: US 6,739,410 B2
(45) Date of Patent: May 25, 2004

(54) SONIC DRILL HEAD

(75) Inventors: Brian Smith, LaPorte, IN (US); James Lange, LaPorte, IN (US)

(73) Assignee: Diedrich Drill, Inc., LaPorte, IN (US)

( * ) Notice: Subject to any disclaimer, the term of this patent is extended or adjusted under 35 U.S.C. 154(b) by 0 days.

(21) Appl. No.: 10/083,206

(22) Filed: Feb. 26, 2002

(65) Prior Publication Data

US 2002/0117334 A1 Aug. 29, 2002

Related U.S. Application Data

(60) Provisional application No. 60/271,459, filed on Feb. 26, 2001.

(51) Int. Cl.[7] ..... E21B 7/24

(52) U.S. Cl. ..... 175/55; 175/56; 173/49; 173/213

(58) Field of Search ..... 175/55, 20, 56, 175/1, 22; 173/49, 213; 172/40; 74/61; 184/69

(56) References Cited

U.S. PATENT DOCUMENTS

| | | | | |
|---|---|---|---|---|
| 1,763,146 A | | 6/1930 | Goodwin | |
| 2,743,585 A | * | 5/1956 | Berthet et al. | 74/61 |
| 3,190,369 A | * | 6/1965 | Pyles | 173/49 |
| 3,217,551 A | | 11/1965 | Bodine, Jr. | |
| 3,467,207 A | * | 9/1969 | Pyles et al. | 175/55 |
| 3,786,874 A | | 1/1974 | Jodet et al. | |
| 4,023,628 A | | 5/1977 | Bodine | |
| 4,217,753 A | | 8/1980 | Loretan | |
| 4,403,665 A | | 9/1983 | Bodine | |
| 4,662,459 A | | 5/1987 | Bodine | |
| 4,693,325 A | | 9/1987 | Bodine | |
| 4,809,790 A | * | 3/1989 | Manchak, Jr. | 175/20 |
| 5,027,908 A | | 7/1991 | Roussy | |
| 5,086,854 A | | 2/1992 | Roussy | |
| 5,409,070 A | | 4/1995 | Roussy | |
| 5,417,290 A | | 5/1995 | Barrow | |
| 5,417,673 A | | 5/1995 | Gordon | |
| 5,540,295 A | | 7/1996 | Serrette | |
| 5,549,170 A | | 8/1996 | Barrow | |
| 5,562,169 A | | 10/1996 | Barrow | |
| 5,812,068 A | | 9/1998 | Wisler et al. | |

FOREIGN PATENT DOCUMENTS

| | | | | |
|---|---|---|---|---|
| EP | 0 240 810 A2 | | 10/1987 | |
| JP | 10054432 | | 2/1998 | |
| SU | 1078018 | * | 3/1984 | 175/55 |

OTHER PUBLICATIONS

"Mutually–opposed springs", undated, p. 15.

Boart Longyear Company, "Enviromental Drilling Division: Sonic Drilling", undated,12 pages.

"Sonic Drilling Ltd.: Industry in Action", undated, 2 pages.

"Mechanisms simplify timing between shafts", undated, 2 pages.

Smallwood, David O., "Vibration Testing Machines", Shock and Vibration Handbook, 4th Edition, Cyril M. Harris, undated, 5 pages.

* cited by examiner

*Primary Examiner*—David Bagnell
*Assistant Examiner*—Matthew J Smith
(74) *Attorney, Agent, or Firm*—Baker & Daniels

(57) ABSTRACT

A sonic drilling head includes a spindle which is both rotated and vibrated at sonic frequency to effect ground penetration of members such as drill rods, etc. Two pairs of rotating eccentric masses are mounted in a sine generator housing. The pairs of masses have intersecting axis. A spiral bevel gear and drive shaft rotate the first pair of masses which engage the second pair of masses so that the pairs of masses are driven in opposite directions. Rotation is imparted to the spindle through a geared bearing isolated by a pack of precision disc springs, which also cooperate with a second set of precision disc springs to isolate the vibrations of the rotating eccentric masses from an outer housing of the sonic drill head.

38 Claims, 15 Drawing Sheets

SONIC DRILL HEAD

This application claims the benefit of U.S. Provisional Application No. 60/271,459 filed Feb. 26, 2001

BACKGROUND OF THE INVENTION

This invention relates to a sonic or sine generator drilling head for use on a drill rig.

Soil samples may be taken by at least two methods: drilling and by directly driving samplers into the earth. Sonic drilling is a method of driving a sampler in which vibratory energy is applied to the drill rod. This technique is particularly effective when the vibrations coincide with the natural resonant frequency of the drill rod or casing, because the effective force generated at the bit face is significantly multiplied. The vibrational force causes soil particles along the side of the drill to fluidize or break apart from the surrounding ground. The term "sonic drilling" stems from the fact that the frequency of vibrations normally used is in the 50–200 Hertz range, which is within the lower range of audible sound that can be detected by the human ear. In addition to earth probing, vibrational force can be used to facilitate installation of other objects into the ground.

Various techniques are available for providing the vibrational force necessary for sonic drilling. One method is a direct-drive vibration machine.

An example of a sonic drill utilizing a direct-drive mechanical vibration or brute force mechanism is shown in U.S. Pat. Nos. 5,027,908 and 5,409,070 both to R. Roussy, incorporated herein by reference. The Roussy design features a motor connected to and driving a horizontal shaft through a pair of splined gears. The shaft is connected to a crank by means of a second shaft having ball ends with splined connections. A pair of the cranks drive offset counter rotating rollers. Each roller is housed in a cylindrical cavity. The offset rollers provide a cam movement to the following cylindrical cavities resulting in a vibrational up-and-down motion of vertical shafts and the drill string.

BRIEF SUMMARY OF THE INVENTION

According to one embodiment of the present invention, four eccentric masses are rotatably mounted in a sine generator housing, with each of the masses offset from an adjacent mass by 90°, so that the four eccentric masses are on mutually perpendicular intersecting axes, which also intersect the axis of the spindle. A spiral bevel gear drives two of the eccentric masses through gear teeth on the masses, and the driven masses drive the other two masses through corresponding gear teeth. The spiral bevel gear is rotated by a drive shaft which connects the spiral bevel gear to a speed increaser assembly mounted on the outer housing. The drive shaft allows for parallel, axial, and angular misalignment with respect to the spiral bevel gear and the speed increaser assembly, which is driven by a drive motor. In one embodiment, the drive shaft is connected to the spiral bevel gear and to a speed increaser pinion through splined connections and is biased vertically by a pack of disc springs, to preload upper and lower retainers mating with spherical surfaces of an end of the shaft. The spindle is rotated by a separate rotary drive motor, which drives a drive gear connected to the sine generator housing. The rotary drive motor is mounted to an outer housing and separated from the sign generator assembly by a pack of precision disc springs. Another set of precision disc springs are mounted between the drilling spindle and another bearing that is supported by the housing. Together, these packs of precision disc springs isolate the drive mechanisms and the outer housing from the vibrations of the sine generator.

These and other features of the present invention will become apparent from the following description, with reference to the accompanying drawings, in which:

DETAILED DESCRIPTION

Figure 1:
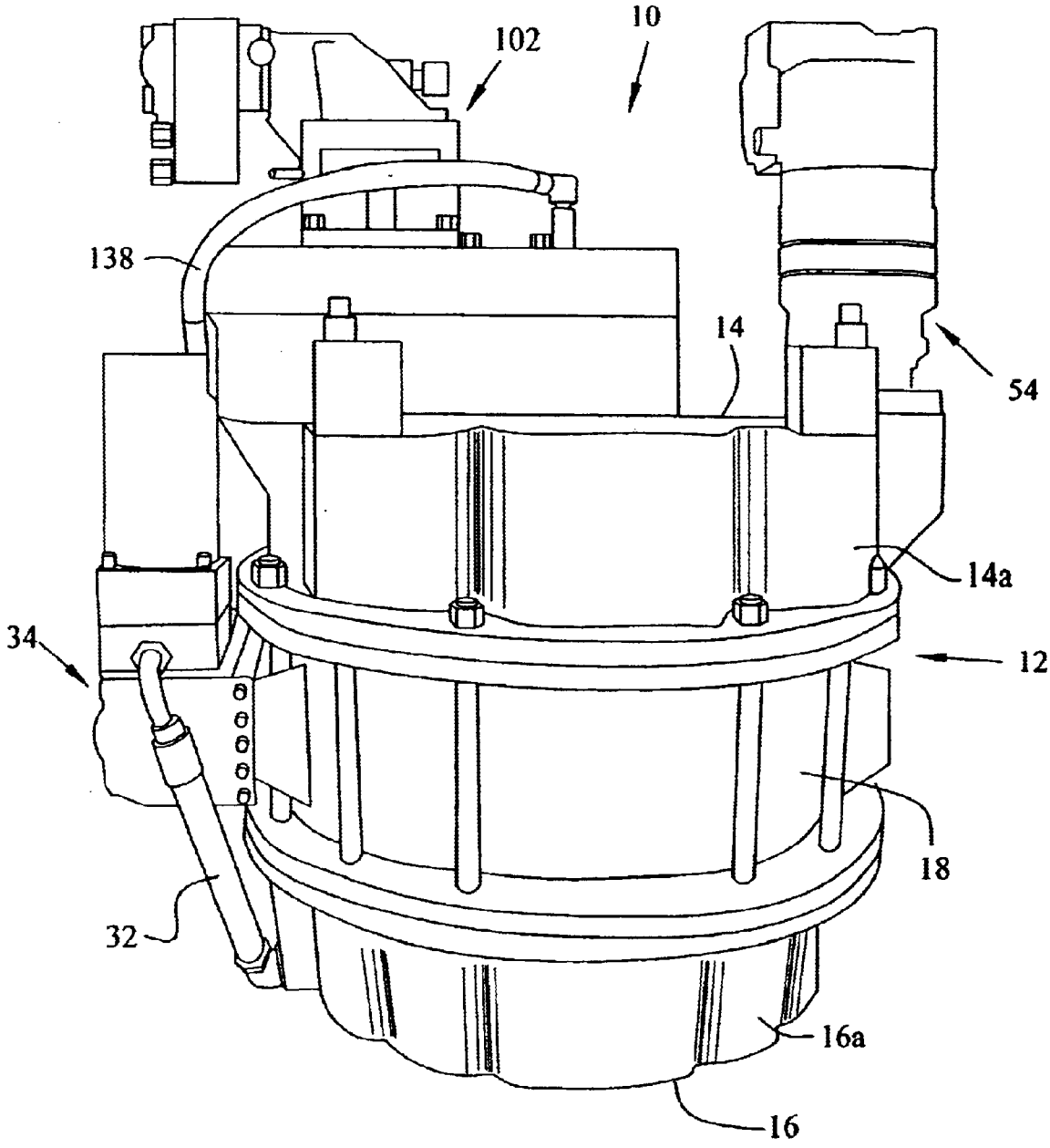
FIG. 1 is a front view of the sonic drill head showing a lubrication pump on the left of the housing, a rotary spindle drive motor at the upper right of the housing, and a sonic drive motor at the top of the housing.
Figure 2:
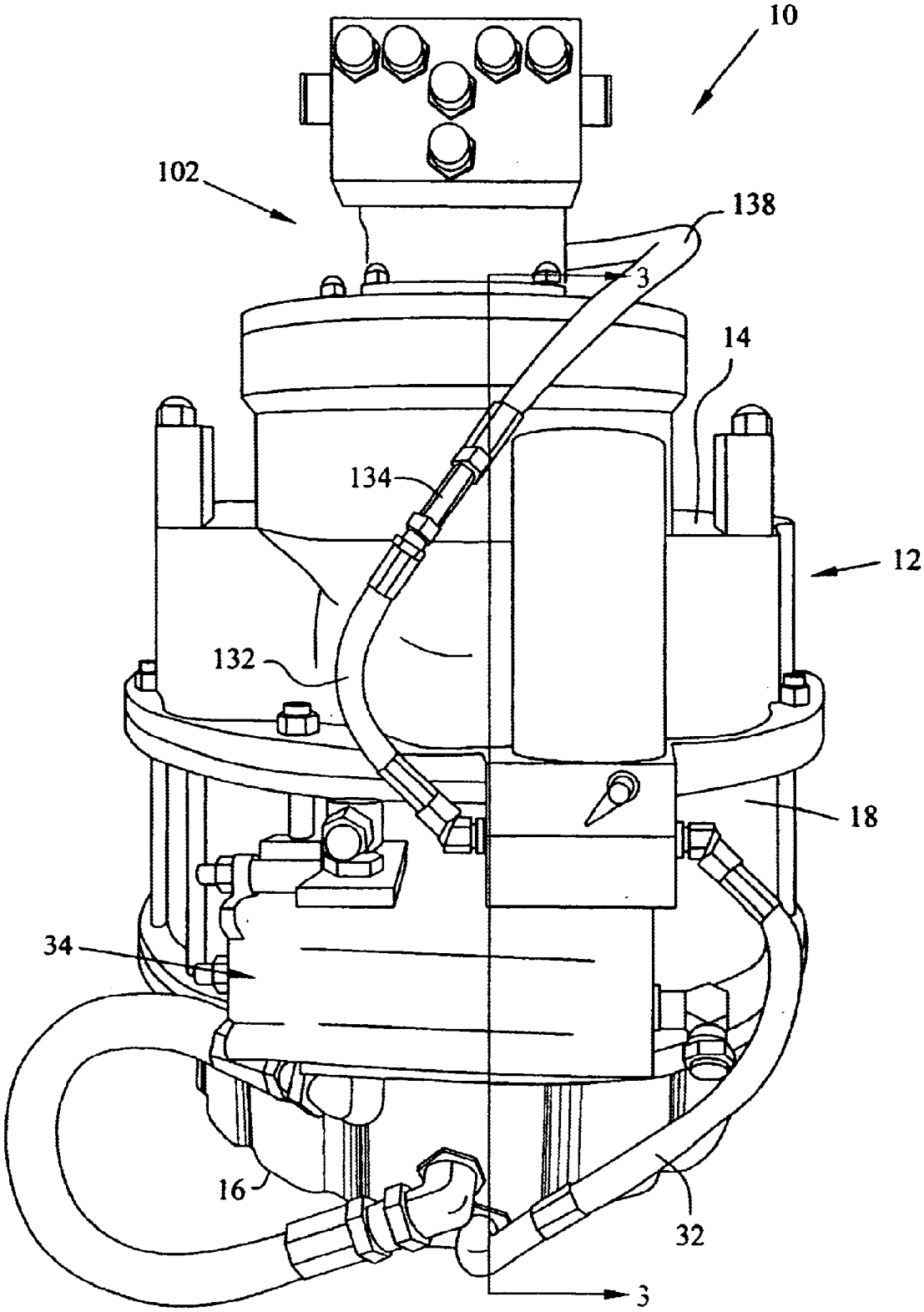
FIG. 2 is a side view of the sonic drill head of the present invention shown from the side where the lubrication pump is mounted.
Figure 3:
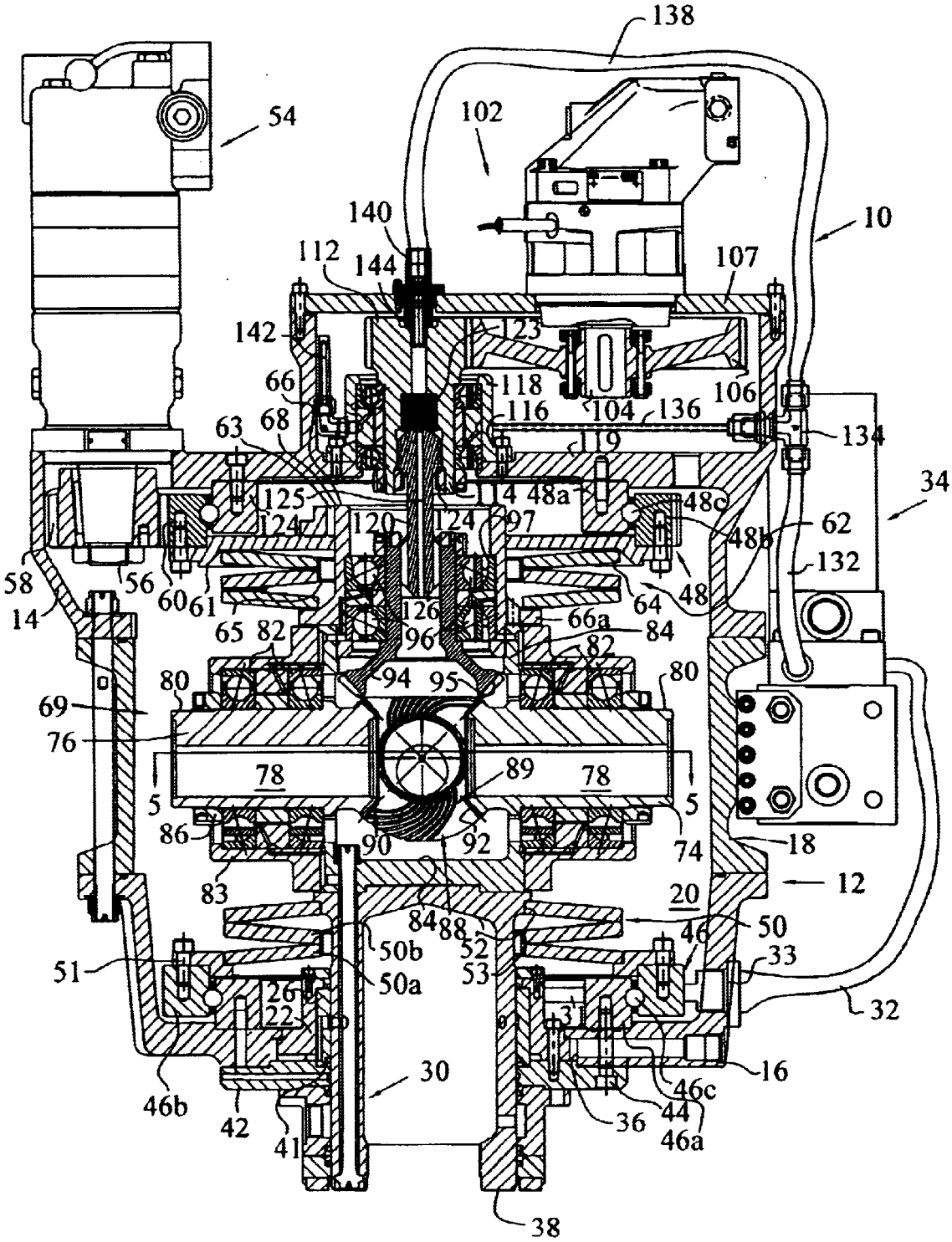
FIG. 3 is a longitudinal cross sectional view taken along line 3—3 of FIG. 2 of one embodiment of a sonic drill head made pursuant to the teachings of the present invention.

Referring now to the FIGS. 1–5, a sonic drill head generally indicated by the numeral 10 includes an outer housing 12 which is adapted to be installed on a feed frame (not shown) of a conventional drill rig (not shown). The feed frame, as is well known to those skilled in the art, is adapted to be raised for drilling to a vertical or angular position and lowered for travel of the sonic drill head 10. In one embodiment the rig is provided with a torque generating rotary actuator (not shown) for rotating sonic drill head 10 to a horizontal position when the actuator is charged with hydraulic fluid. For safety purposes, it is best that this system include fail safe brakes that will lock the rotation of the unit in the event pressure is lost in the hydraulic fluid.

Outer housing 12 includes an upper end wall or cap 14, a lower end wall or cap 16, and a circumferentially extending side wall 18 which interconnects the upper end wall 14 and lower end wall 16. As can be seen, end walls 14 and 16 include circumferentially extending sidewall wall portions 14*a* and 16*a*, respectively. End walls 14, 16 and side wall 18 define an inner cavity 20 within outer housing 12. A spindle support 22 extends from the lower end wall 16 into inner cavity 20. Spindle support 22 carries a circumferentially extending hydrodynamic guide or sliding bushing 26, which supports a spindle generally indicated as 30 and permits rotation and axial displacement thereof. Pressurized hydraulic fluid can flow to sliding bushing 26 through a hydraulic fitting (not shown), which receives the fluid through an internal fluid line 31 and an external fluid line 32 that are interconnected by a fitting 33 located in a bore through lower end wall 16. The hydraulic fluid is pressurized and circulated by a lubrication pump 34 mounted to the exterior of outer housing 12. The spindle 30 extends through an aperture 36 in lower end wall 16 and terminates in an end 38, which carries drill rod adaptors (not shown), which are used to connect a drill rod to end 38 of spindle 30. The term "drill rod" is used in the generic sense, and may include any type of earth samplers or other ground penetrating objects. A seal 41 and bracket 42 around lower end 38 of spindle 30 are mounted to lower end wall 16 by bolts (not shown) threaded in apertures 44.

Spindle 30 is supported for rotation within outer housing 12 by a lower bearing 46 and is bolted to a sine generator housing 84. In one embodiment, bearing 46 and an upper bearing 48 are four point contact bearings, and include inner races 46*a*, 48*a*, outer races 46*b*, 48*b*, and roller bearing elements 46*c*, 48*c*, respectively. Inner race 46*a* of lower bearing 46 is supported directly on lower end wall 16. Precision disc springs 50, having individual discs 50*a*, 50*b*, and 50*c* and which are well known and also sometimes referred to as Belleville spring washers, extend between a flange 51 mounted to outer race 46*b* of lower bearing 46 and a circumferentially extending shoulder 52 on spindle 30. Axial alignment of disc springs 50 may be maintained by a retaining ring 53 located adjacent discs 50*a*, 50*b*. Accordingly, disc springs 50 not only support spindle 30 for rotation with respect to outer housing 12 via the four point contact bearings 46, but also isolate the vibratory motion of spindle 30.

Figure 4:
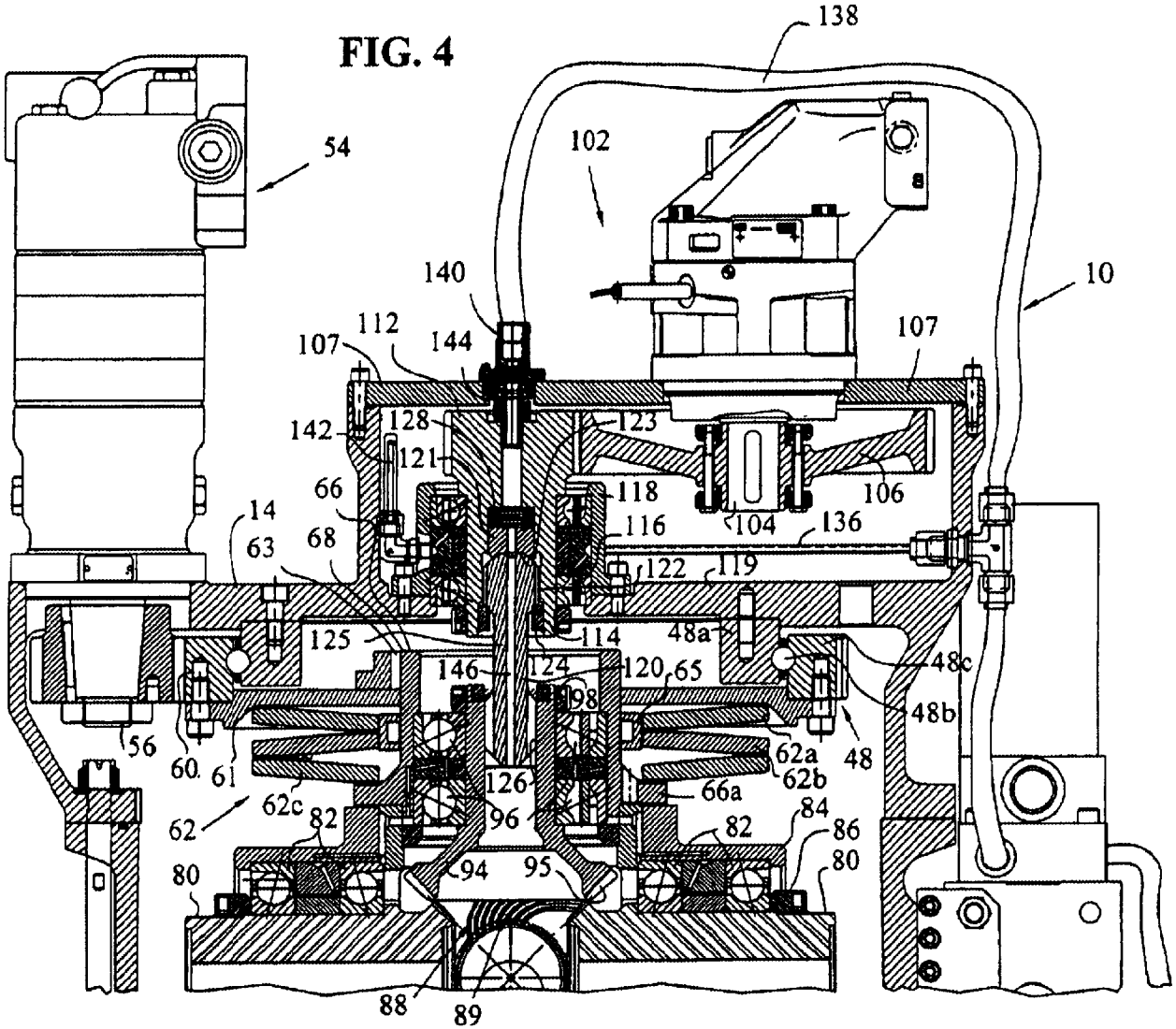
FIG. 4 is an enlarged version of the upper part of the sonic drill head of FIG. 3, illustrating in detail the drive between the sonic drive motor and a spiral bevel gear.

Spindle 30 is rotated by a rotary drive motor generally indicated by the numeral 54. Rotary drive motor 54 may be, for example, a hydraulic drive motor of a type well known to those skilled in the art. Rotary drive motor 54 is mounted on outer housing 12 and includes an output shaft 56. A pinion 58 is mounted on output shaft 56. Pinion 58 drives a gear 60, which is formed on or attached to outer race 48*b*. A collar 61 is mounted to outer race 48*b*. Collar 61 is used to preload and laterally position a second pack of disc springs 62 having individual discs 62*a*, 62*b*, and 62*c*. Also, attached to collar 61 is a spline 63. Disc springs 62 extend between a lower shoulder 64 of collar 61 and a shoulder 66*a* of a coupling 66. Like disc springs 50, disc springs 62 consist of resilient members and axial alignment may be maintained by an upper retaining ring 65 located at the inner diameter of discs 62*a*, 62*b* (FIG. 4). Rotation of spindle 30 is accomplished by transmission of motion from pinion 58 through gear 60, which in turn rotates spline 63. Spline 63 engages splines 68 formed on or attached to the outside diameter of coupling 66. Disc springs 50 and 62 are able to expand and contract axially to isolate the vibrations of a vibratory generator generally indicated by 69 and spindle 30. It should be noted that disc springs 50 and 62 are compressively preloaded so that a compression load is maintained on the springs throughout the full vibratory cycle of the unit.

Figure 5:
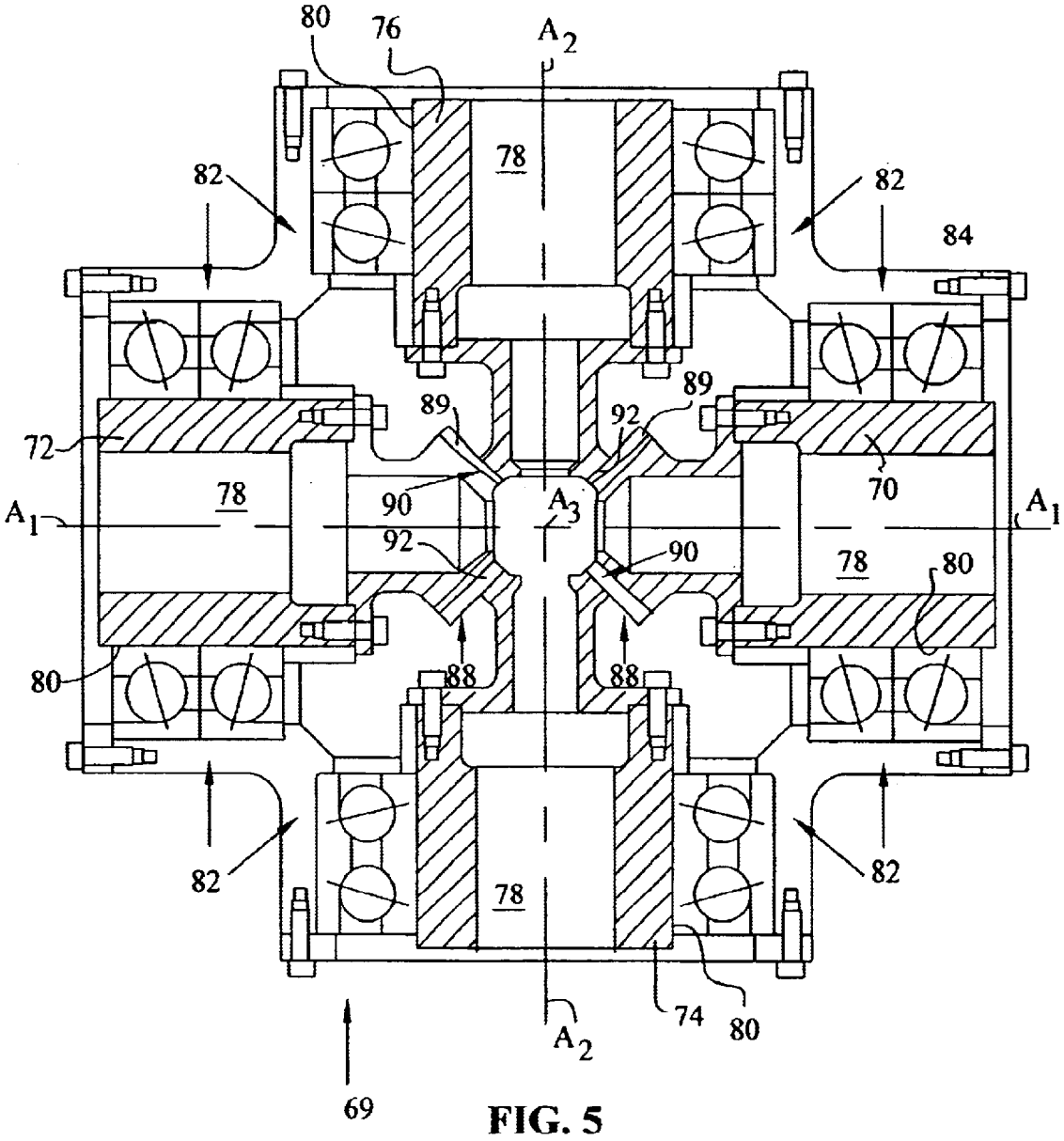
FIG. 5 is a transverse cross sectional view taken substantially along line 5–5 of FIG. 3, showing 2 pairs of eccentric members and illustrated with each eccentric member having a two part configuration.

Vibratory force is applied to spindle 30 by sine or vibratory wave motion generator 69. The terms "sine" and "vibratory" are used interchangeably herein. Sine wave generator 69 includes a first pair of eccentric or unevenly balanced masses 70, 72 (FIG. 5) and a second pair of eccentric masses or unevenly balanced masses 74, 76. In the embodiment shown, each of masses 70–76 has a through bore 78, which is formed off-center to provide unbalance in the masses. Each of the masses also includes an outer circumferential surface 80 which is journaled for rotation by bearings 82 that are mounted in bearing caps 83 of the sine generator housing 84 to support the masses 70–76. In one embodiment, bearings 82 are super precision class bearings of the angular contact ball type. The outer races of bearings 82 are held in position by bearing caps 83, and inner races are preloaded by locknuts 86 threaded onto the outer circumferential surface 80 of masses 70–76. Accordingly, masses 70–76 are journaled for rotation relative to bearing caps 83 by bearings 82. As best shown in FIG. 5, it will be noted that masses 70 and 72 are coaxial $A_1$, and masses 74, 76 rotate about a common axis $A_2$, which intersects with and is mutually perpendicular to the axis of rotation $A_1$ of masses 70 and 72. These axes are also mutually perpendicular to and intersect an axis $A_3$ of the spindle.

Masses 70 and 72 each include a conical face 88 at one end thereof which carry teeth 89 which extend along the entire length of conical face 88. Masses 74 and 76 each include a conical face 90, which are shorter than conical faces 88 and carry correspondingly shorter teeth 92. Shorter teeth 92 mesh with those portions of teeth 89 closest to the axis $A_3$ of spindle 30. A spiral bevel gear 94 includes teeth 95 meshing with those portions of teeth 89 that are radially outward from the axis of spindle 30. Spiral bevel gear 94 is journaled for rotation by bearings 96 which are supported on cap or coupling 66. The outer race of bearings 96 is held in place by a lip 97 on the inside diameter of coupling 66, and the inner race is secured by a bearing retainer locknut 98 threaded onto the outside diameter of spiral bevel gear 94. Accordingly, rotation of spiral bevel gear 94 causes rotation of the masses 70 and 72 relative to spindle 30, which in turn cause rotation of masses 74 and 76 through teeth 89 and 92. The sine generator housing 84 has lubrication jets (not shown) in the upper and bottom thereof directing oil on the gear teeth of the eccentric masses. The four eccentric mass caps 83 are bolted (not shown) to sine generator housing 84 and have lubrication channels to lubricate the bearings.

Spiral bevel gear 94 is driven by a drive motor generally indicated by the numeral 102. In one embodiment, drive motor 102 is a hydraulic motor driven by the drill rig hydraulic system (not shown) and includes an output shaft 104 which drives a gear 106. Drive motor 102 is mounted to a cap 107 that closes off the top of upper end wall 14. The gear 106 drives gear or pinion 112 having a hub 114 that is supported by bearings 116, which are in turn supported by bearing housing or cap 118 that is mounted to an internal wall 119 of upper end wall 14. The larger gear 106 acts as a speed increaser to gear 112.

Figure 6:
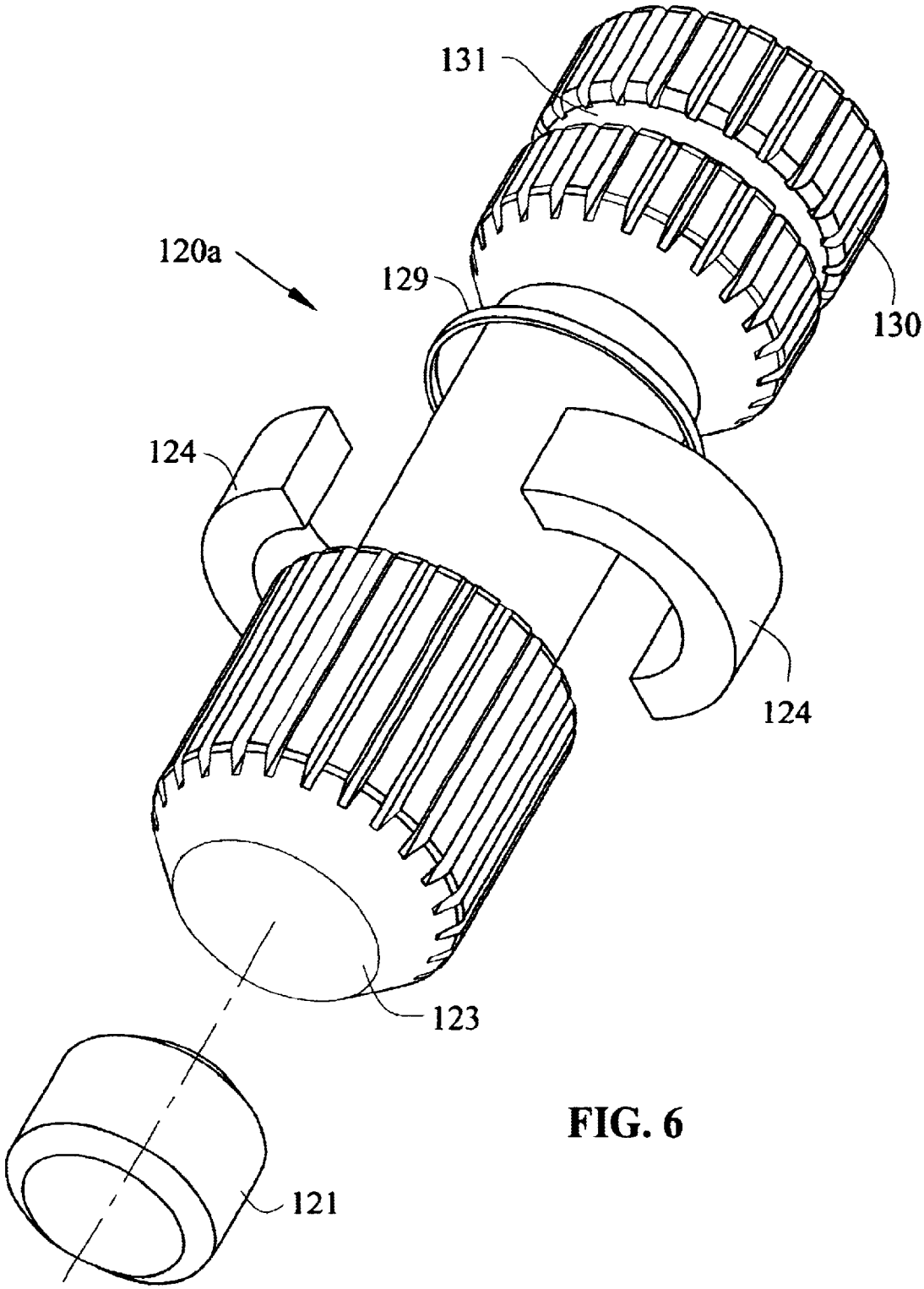
FIG. 6 is an exploded perspective view of an alternate embodiment sonic drive shaft having a circumferential groove through the lower splines along with a bushing having a spherical seat, a split ring bushing, and a snap ring.

One end of a drive shaft 120 extends into hub 114 and is connected thereto by a splined connection 122, so that the drive shaft 120 is driven by gear 112. The top of drive shaft 120 is rounded and bears against a bushing 121 having a spherical seat 123 for accepting the upper rounded end of drive shaft 120. A split ring bushing 124 having an inner diameter smaller than the upper end of drive shaft 120 maintains drive shaft 120 and splined connection 122 as shown. Split ring bushing 124 also has a spherical seat contacting drive shaft 120 below splined connection 122. Springs 128 are mounted above bushing 121 in hub 114 to preload the drive shaft and to limit and cushion upward movement of drive shaft 120. Springs 128 are preferably a pack of spring washers/disc springs. A snap ring 129 is best shown with an alternate embodiment drive shaft 120*a* in FIG. 6. Snap ring 129 fits into a groove (not shown) on the internal diameter of hub 114 and holds the pack of disc springs 128 under a constant compressive force. The internal diameter of split ring bushing 124 is larger than the mid-diameter 125 of drive shaft 120 so that the drive shaft may tilt slightly about its vertical axis to allow for misalignment. The opposite end of drive shaft 120 is connected to spiral bevel gear 94 through a lower splined connection 126. In the alternate embodiment of FIG. 6, drive shaft 120*a* includes lower splines 130, which have a circumferential groove 131 cut therethrough to enhance lubrication of connection 126.

Lubrication for bearings 116 and splined connections 122 and 126 is provided by lubrication pump 34. It is important to the proper operation of the sonic drill unit that proper lubrication be maintained, and that the discharge of lubrication pump 34 be prevented from going dry. In one embodiment shown, the output section of the combination lubrication pump/motor is approximately 15%–25% times larger than the input section to help preclude a fill up condition in housing 12. From lubrication pump 34, a lubricating fluid is pumped through line a 132 into a T-fitting 134. From T-fitting 134 the fluid is split and part of it is pumped through a line 136 for lubricating bearings 116, and the remainder of the fluid is pumped through a line 138 into a fitting 140 mounted at the top of cap 107. The meshing of gear 106 with gear 112 is lubricated by a hydraulic fitting 142 which receives lubricating fluid through line 136 and sprays the fluid on the splines of the gears. Fluid communicated through the line 138 is passed to the internal portion of gear 112 to lubricate splined connection 122 through a rotary fluid union 144 as is well known in the art. A portion of the fluid is also transmitted by a through bore 146 to lubricate lower splined connection 126. Through a line 32, lubrication pump 34 provides lubrication to the lower bearings and hydrodynamic guide 26. It should be noted that the other bearings and drive connections in sonic drill head 10 are lubricated through a series of internal ports, which receive fluid from lubrication pump 34 through the above-mentioned lines. In a typical application, the lubrication will be retrieved from the bottom of outer housing 12 and pumped through a line (not shown) to a drill rig (not shown) where it will be filtered and returned to lubrication pump 34 for redistribution throughout sonic drill head 10.

In operation, the output of drive motor 102 is transmitted through gears 106, 112 and drive shaft 120 to rotate spiral bevel gear 94. Since spiral bevel gear 94 is engaged with masses 70 and 72, rotation of spiral bevel gear 94 also rotates masses 70 and 72. Since masses 70 and 72 are connected with masses 74 and 76, masses 74 and 76 will also be rotated, but in a direction opposite to that of masses 70 and 72. It will be noted that spiral bevel gear 94 does not directly engage masses 74 and 76. Accordingly, the masses are counter rotating and rotate relative to bearing caps 83, thereby setting up a reaction type vibration system. The amplitude of the vibrations and their frequency are a function of several factors including the mass and eccentricity of masses 70–76, and the speed at which the masses are driven. In any event, vibrations are transmitted through spindle 30 to the drill rod and bits (not shown) penetrating the ground. With the above described assembly and operation, gears 106 and 112 and drive motor 102 are isolated from the vibrations. Similarly, disc springs 50 and 62 isolate gear 60 and rotary drive motor 54 from vibrations of the spindle.

As the spindle is vibrated by operation of drive motor 102, rotation of the spindle is effected by operation of rotary drive motor 54 and its connection with the spindle through the geared outer bearing race 48*b*. Rotary motion from drive motor 54 is transferred through pinion 58 to outer bearing race 48*b*, which in turn rotates collar 61 attached thereto. Collar 61 rotates coupling 66 through a splined connection. Coupling 66 is connected to and rotates sine generator housing 84, which is connected to and rotates spindle 30. Disc springs 50 and 62 are preloaded by collar 61 which is attached to bearing 48 and provides a resilient connection/coupling and isolate the housing, rotary drive motor 54 and the remaining components from the vibratory motion of the sine generator. Rotation of spindle 30 rotates cutter heads (not shown).

Figure 10:
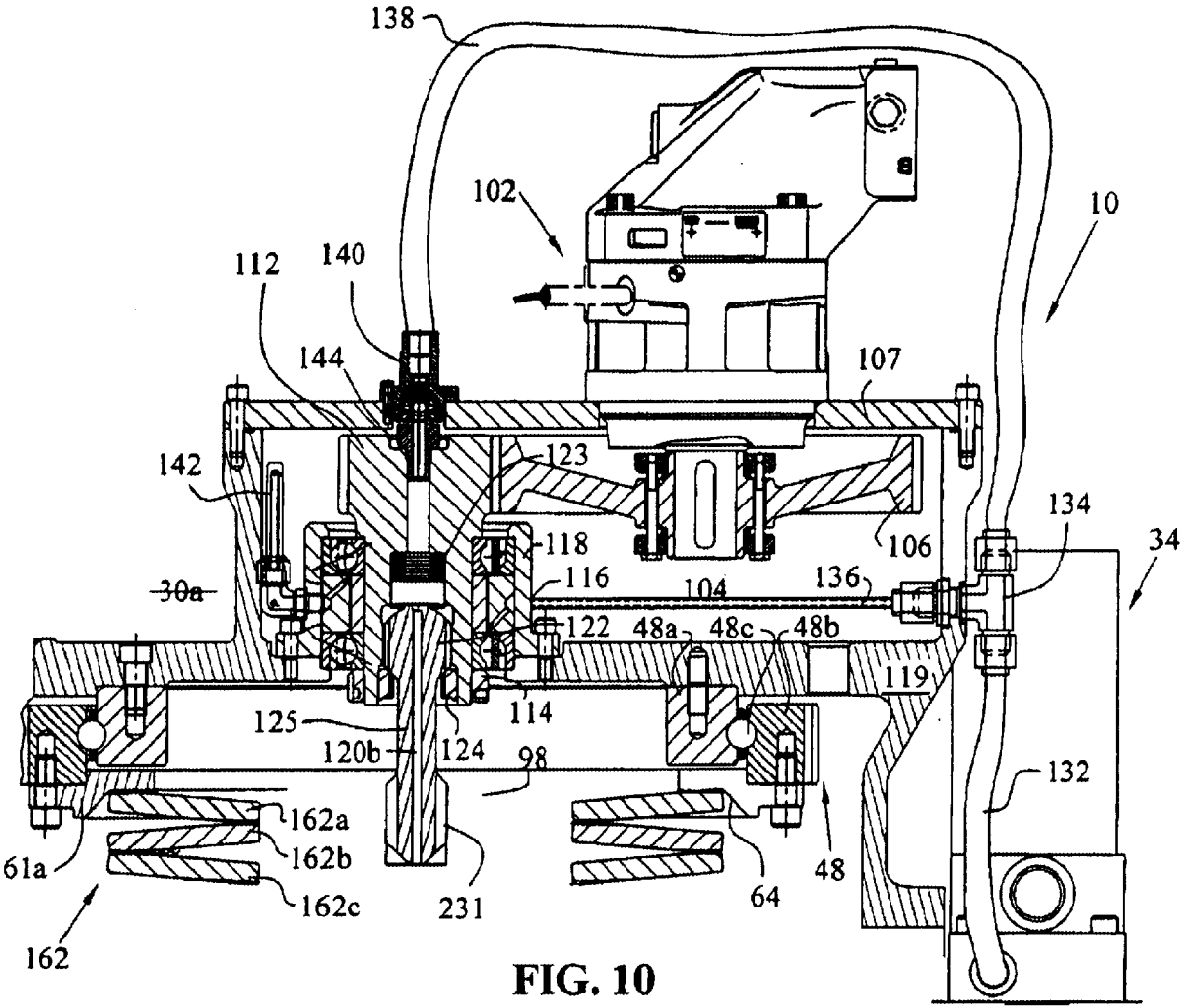
FIG. 10 is a close up cross sectional view of the mounting of the drive shaft of the embodiment in FIG. 7 to a pinion.
Figure 11:
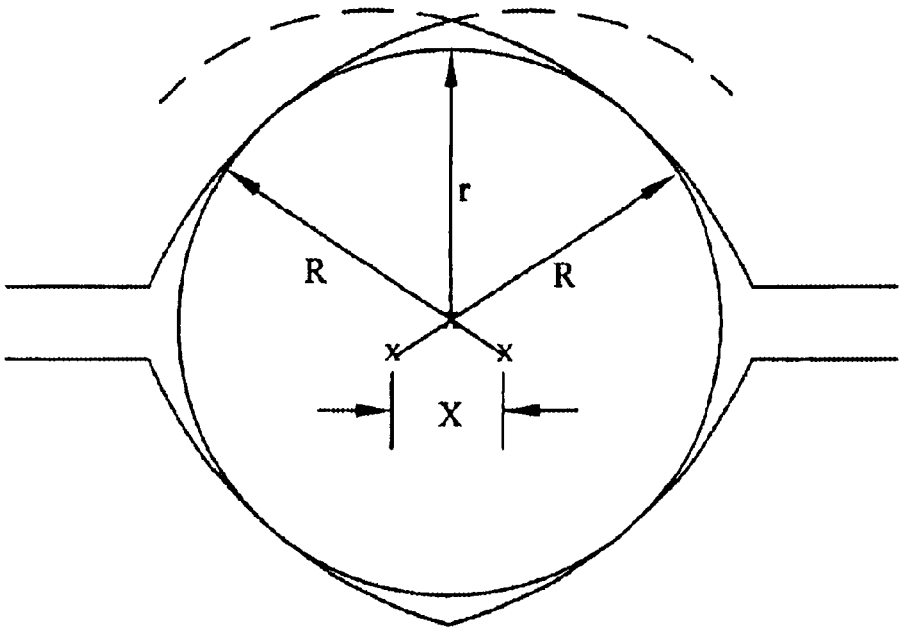
FIG. 11 is a top sectional view taken along line 11—11 of FIG. 9 of the drive shaft drive balls located in gothic archways.
Figure 11A:
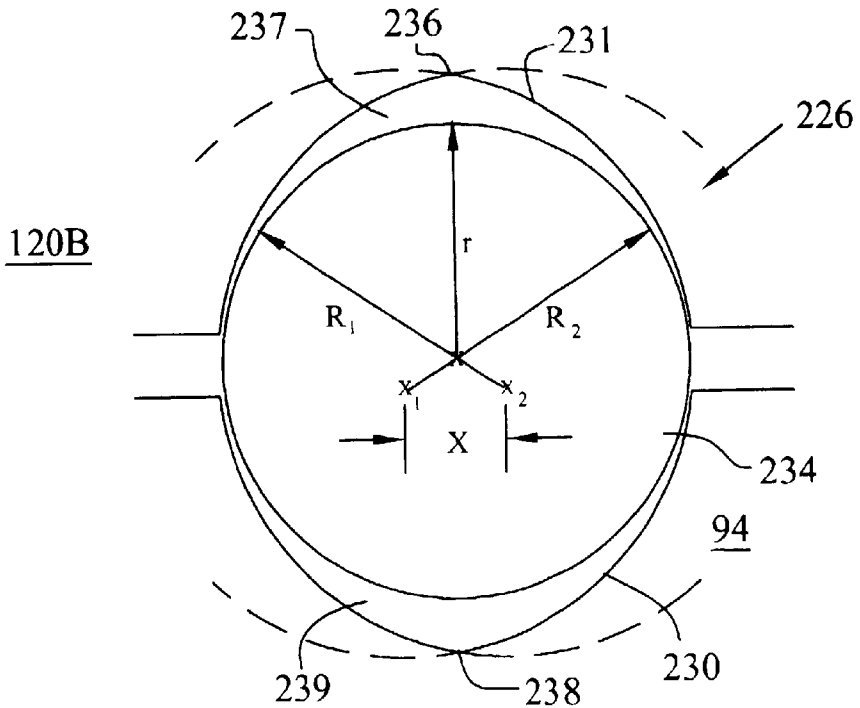
FIG. 11*a* is a close up view of one drive ball taken as shown in FIG. 11 located in the gothic archways.

In FIGS. 7–13, an alternate drive system is shown for sonic drill head 10. This embodiment includes an alternate drive shaft 120*b* utilizing a ball and race drive connection 226 in lieu of a splined connection. As best shown in FIGS. 10, 11 and 11A, drive shaft 120*b* includes a pair of gothic archway shaped raceways 231, and alternate spiral bevel gear 94*a* likewise includes a pair of gothic arch-shaped raceways 230. Gothic raceways 230, 231 extend generally parallel to the axis of spindle 30, and each side of drive connection 226 carries a ball bearing 234 which transmits the drive motion from drive shaft 120*b* to spiral bevel gear 94*a*. As can be seen in FIG. 11A, the gothic archways are formed along intersecting circles having radii R1, R2 with offset centers, x1, x2, respectively. The intersecting circles form an apex 236 in drive shaft 120*b* and an apex 238 in spiral bevel gear 94*a*. This gothic arch raceway configuration will result in a small gap 237 between ball bearing 234 and apex 236 of drive shaft 120*b* and a gap 239 between ball bearing 234 and apex 238 of spiral bevel gear 94*a*. This type of raceway configuration tends to produce 2-point contact between ball bearing 234 and the raceways in each of the drive shaft and spiral bevel gear. It should be noted that this ball and raceway drive connection facilitates relative axial, parallel, and angular misalignment between drive shaft 120*b* and spiral bevel gear 94*a*. Ball bearings 234 can move up and down in raceways 230, 231; however, downward movement of ball bearings 234 is limited as the raceways are constricted towards the bottom of drive shaft 120*b*.

Figure 12:
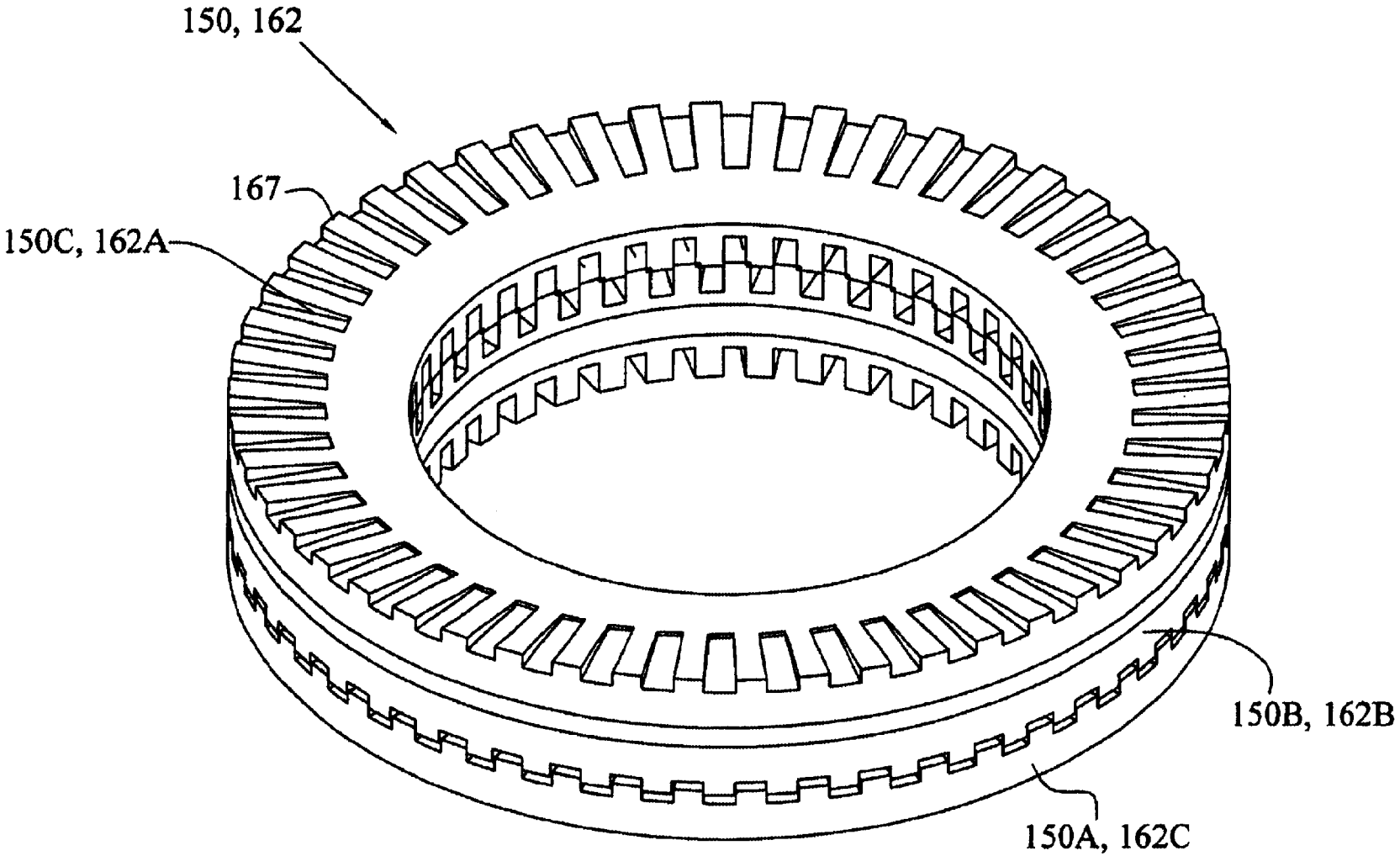
FIG. 12 is a top perspective view of the disc springs used in the embodiment of FIG. 7.
Figure 12A:
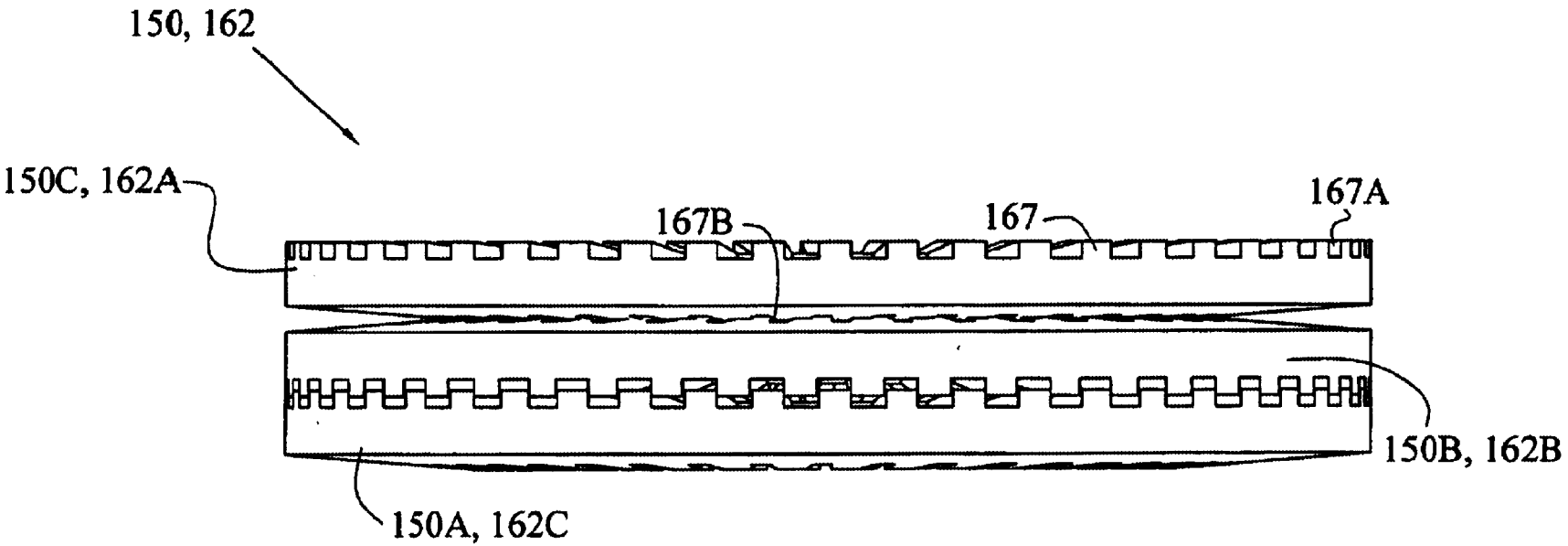
FIG. 12A is a side view of the disc springs of FIG. 12.
Figure 13:
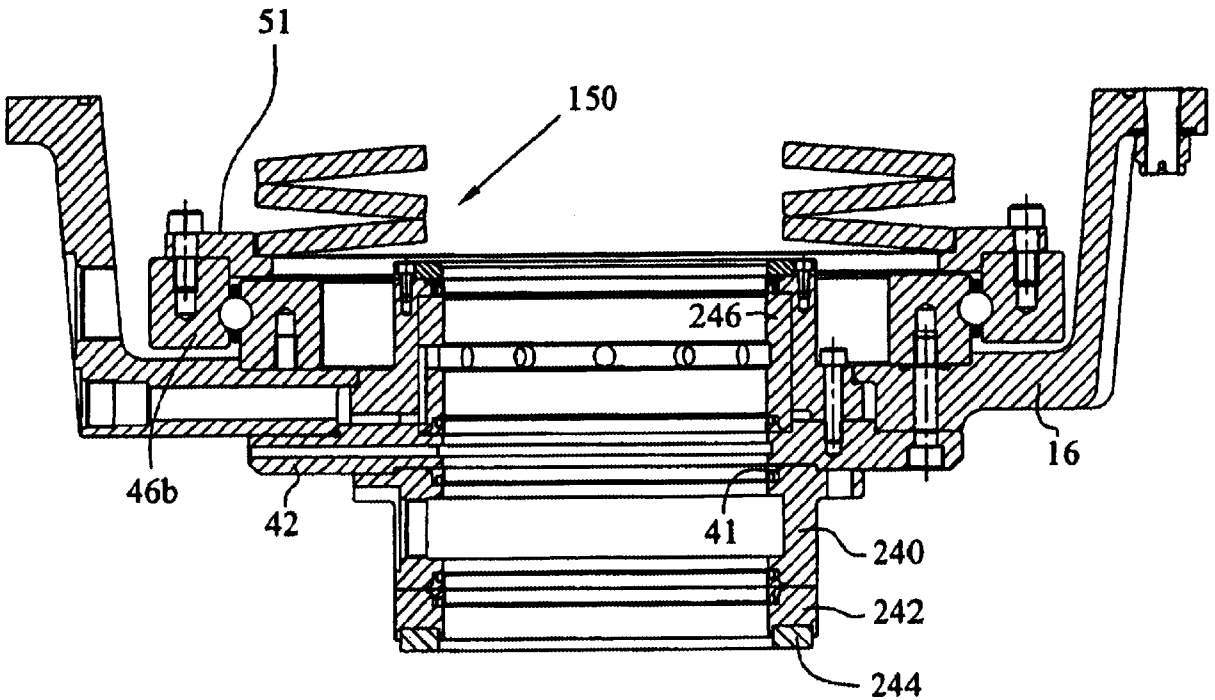
FIG. 13 is a close up cross sectional view of the lower portion of the outer housing and spindle support taken as shown in FIG. 8.

In the embodiment shown in FIGS. 7–13 of sonic drill head 10, an alternate rotary drive connection for rotating spindle 30 is also shown. In this embodiment, collar 61 is not connected to coupling 66 with a splined connection. Rather, an alternate collar 61*a* is used having serrations on lower shoulder 64*a*. These serrations are drivingly engaged with serrations 167 on disc springs 162. As shown in FIGS. 12 and 12*a*, rotary drive motion is transmitted from collar 61*a* through serrations 167 and disc springs 162*a–c* to coupling 66*b*. As with the embodiment shown in FIGS. 3 and 4, rotary motion from coupling 66*b* is transmitted to a spindle 30*a* through the sine generator housing 84.

Facilitating the rotation of spindle 30*a*, is a hydraulic fluid guide or bushing 246 and a water swivel or jacket 240 located outside of outer housing 12. A collar 242 is connected to water cooling bushing 240 and a snubber or bumper 244 is located on the bottom of collar 242 to prevent over stroke of the spindle.

Figure 7:
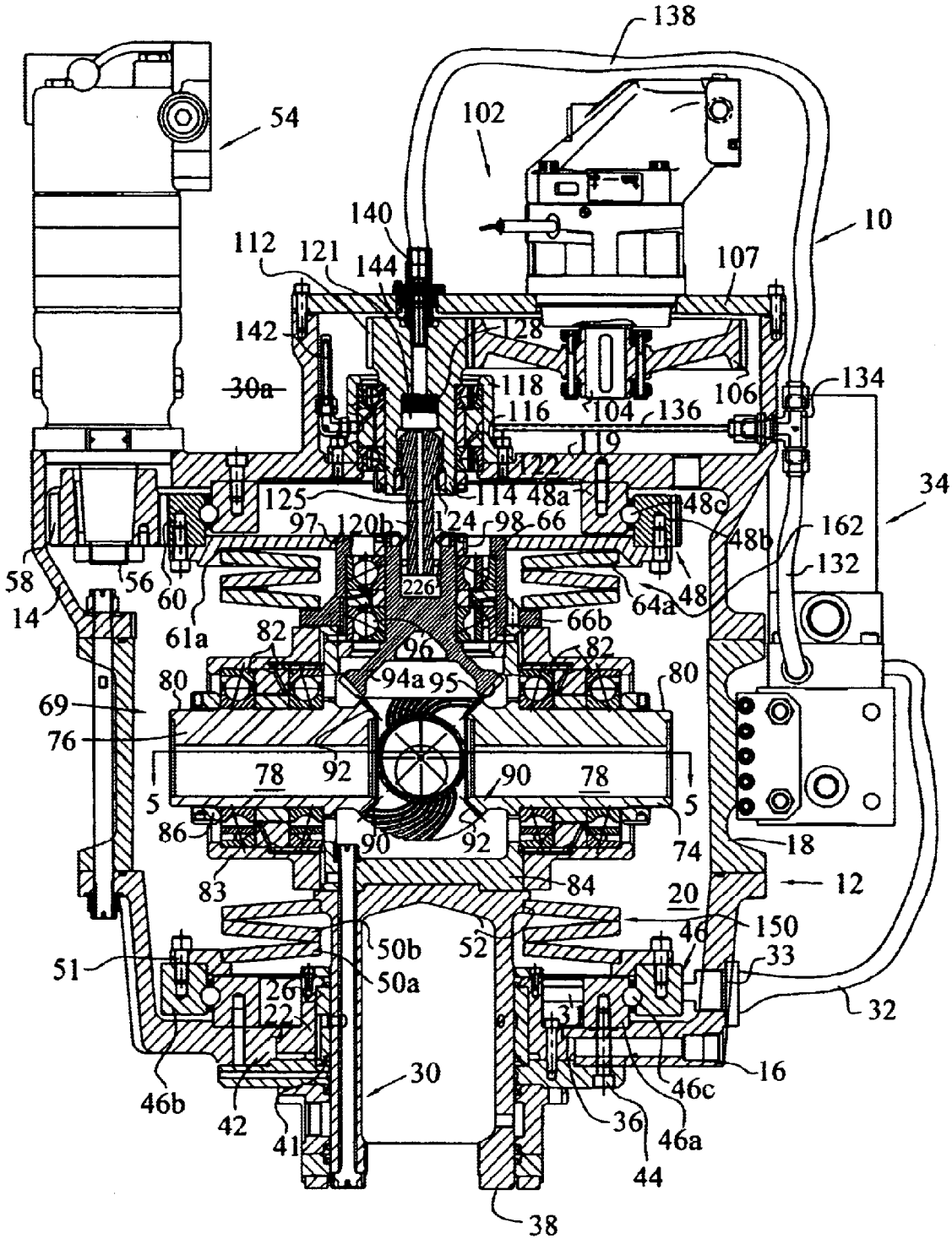
FIG. 7 is a longitudinal cross sectional view taken similar to the view in FIG. 3 of a another embodiment of a sonic drill head made pursuant to the teachings of the present invention.
Figure 8:
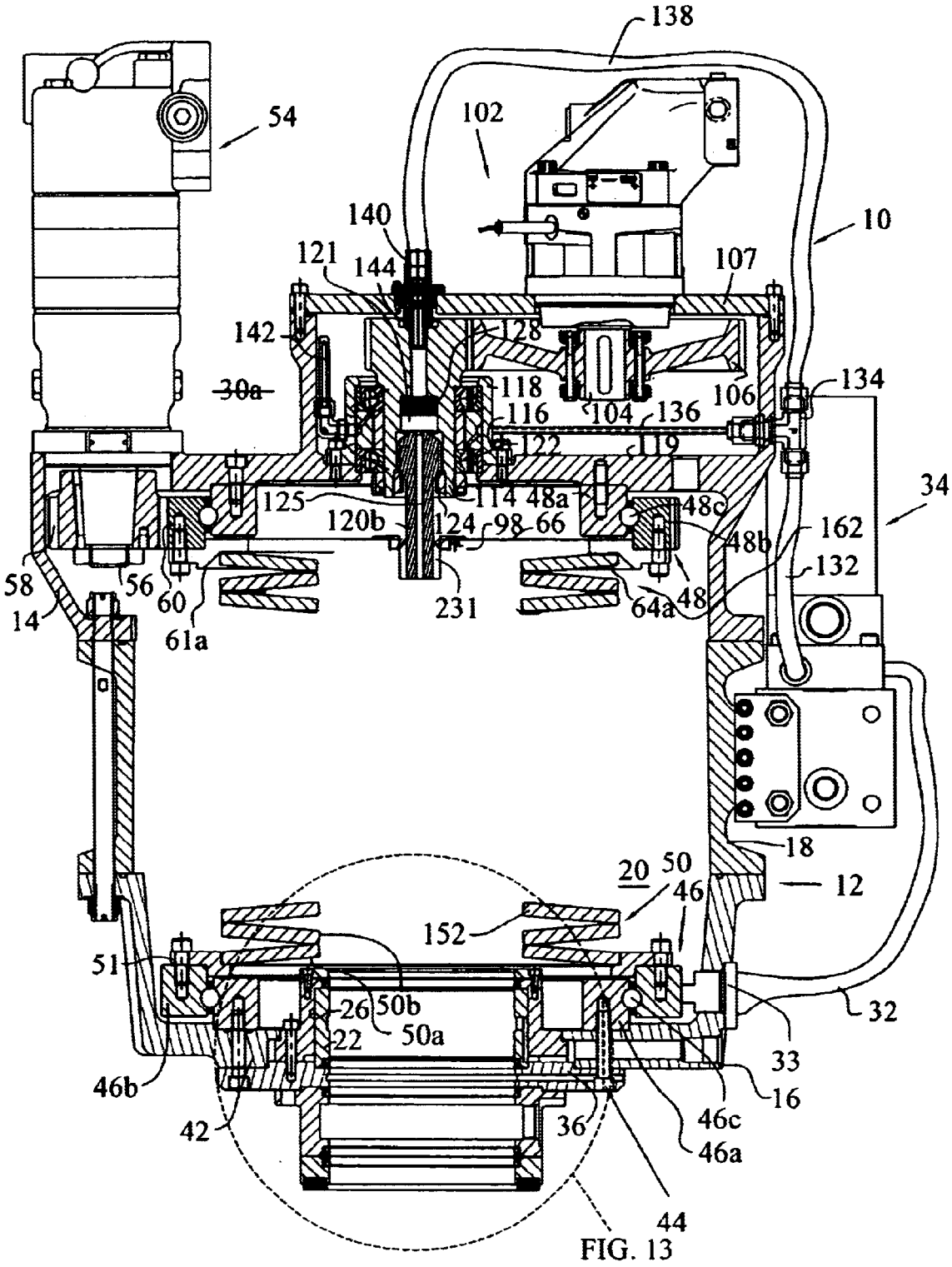
FIG. 8 is a longitudinal cross sectional view of the sonic drill head of FIG. 7 having the sine generator and spindle removed.
Figure 9:
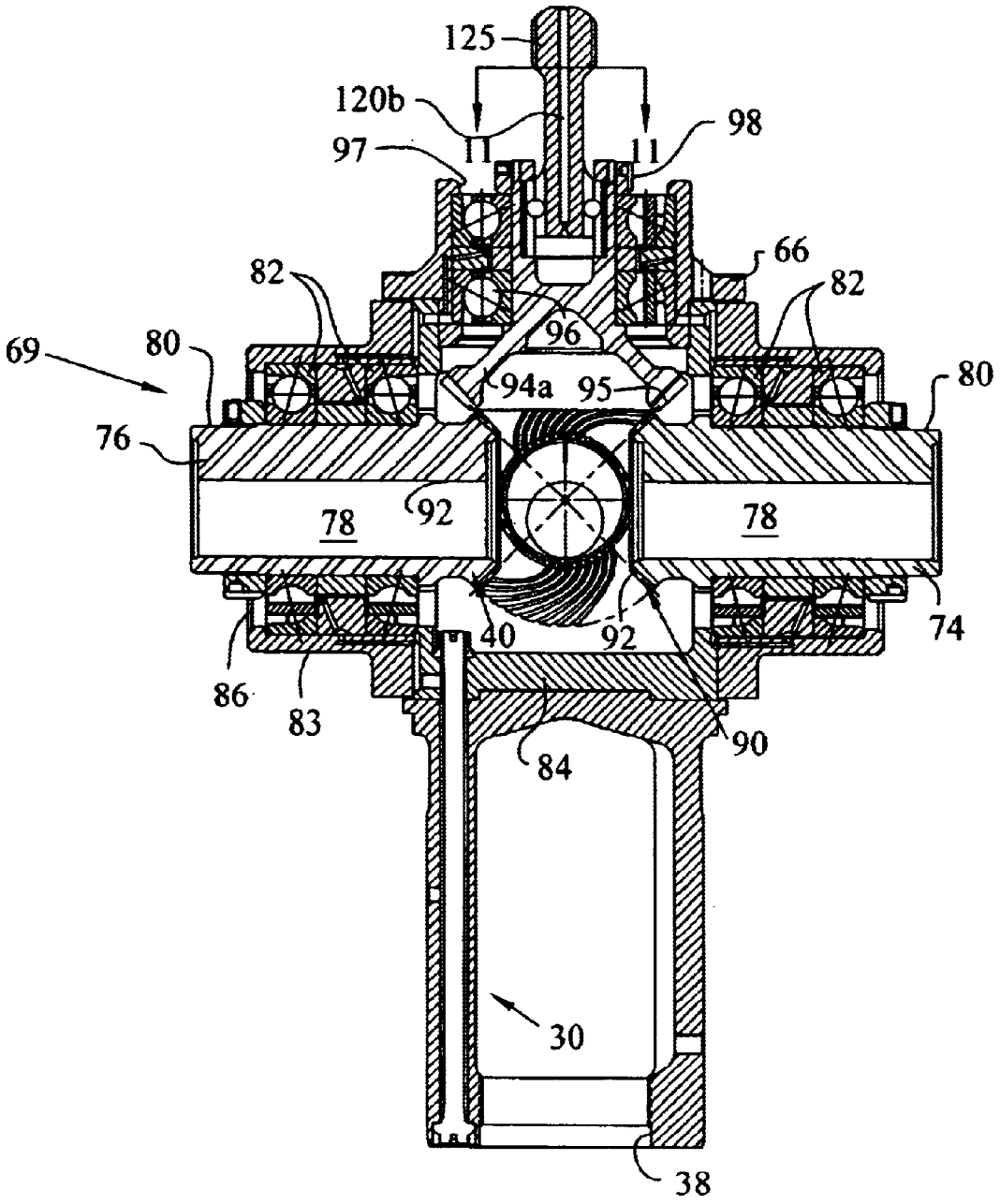
FIG. 9 is a longitudinal cross sectional view of the sine generator and spindle of FIG. 7 removed from the sonic drill head.

While the invention has been disclosed with specific reference to the above embodiments, someone skilled in the art will recognize that changes can be made in form and detail without departing from the spirit and scope of the invention. For instance, as shown in FIG. 7, an alternate embodiment drive shaft 120A may be utilized. It has an external groove through the lower splines for distributing lubricating fluid thereto. Also, although the embodiment shown utilizes four eccentric masses, other numbers of eccentric masses may be used. It should also be realized that other means may be available to provide reactionary-type vibrations provided by the masses. For instance, instead of using off-center bores, the masses may be made with weights on one side to provide an imbalance, or may be made from two or more materials having different densities to provide an uneven weight distribution about the axis of rotation. Also, in FIG. 5, the eccentric masses are shown with a two part construction with an eccentric mass portion bolted to the gear teeth portion, but each mass may also be formed from one solid piece.

Furthermore, other types of springs or bearings may be utilized without departing from the scope of the invention. In addition, it would be possible to vary the types of gears used, and the particular gearing arrangements discussed. The described embodiments, therefore, are to be considered in all respects only as illustrative and not restrictive. The scope of the invention is, therefore, limited only by the appended claims.

What is claimed is:

1. A sine generator drill head including an outer housing, a spindle having a first axis, said spindle being mounted to said housing for rotational and vibrational movement, a first pair of coaxial eccentric masses mounted in a sine generator housing and rotatable about a second axis, and a second pair of coaxial eccentric masses mounted in said sine generator housing and rotatable about a third axis, said first, second, and third axes intersecting, and said first and second pair of eccentric masses imparting said vibrational movement upon said spindle.

2. A sine generator drill head as claimed in claim 1, further including a motor for rotating said first pair of eccentric masses in one direction which rotate said second pair of eccentric masses in the opposite direction.

3. A sine generator drill head including an outer housing, a spindle having a first axis, said spindle being mounted to said housing for rotational and vibrational movement, a first pair of coaxial eccentric masses mounted in a sine generator housing and rotatable about a second axis, and a second pair of coaxial eccentric masses mounted in said sine generator housing and rotatable about a third axis, said first, second, and third axes being perpendicular to one another, the spindle vibrating along the first axis, and said first and second pair of eccentric masses imparting said vibrational movement upon said spindle.

4. A sine generator drill head including an outer housing, a spindle having a first axis, said spindle being mounted to said housing for rotational and vibrational movement, a first pair of coaxial eccentric masses having gear teeth mounted in a sine generator housing and rotatable about a second axis, and a second pair of coaxial eccentric masses having gear teeth mounted in said sine generator housing and rotatable about a third axis, said gear teeth on each of said first pair of eccentric masses engaging gear teeth on each of said second pair of eccentric masses whereby rotation of said first pair of eccentric masses causes rotation of said second pair of eccentric masses, and said first and second pair of eccentric masses imparting said vibrational movement upon said spindle.

5. A sine generator drill head as claimed in claim 4, wherein said first pair of eccentric masses and said second pair of eccentric masses rotate in opposite directions.

6. A sine generator drill head as claimed in claim 5, further including a first gear engaging said teeth on each of said first pair of eccentric masses.

7. A sine generator drill head as claimed in claim 6, wherein said first gear is a spiral bevel gear.

8. A sine generator drill head as claimed in claim 6, further including a motor for driving said first gear.

9. A sine generator drill head as claimed in claim 8, further including a second gear connected to said motor, a third gear engaging the second gear, and a drive shaft connecting said first and third gears which allows for parallel, axial and angular misalignment.

10. A sine generator drill head as claimed in claim 9, further including springs mounted above said drive shaft to preload said drive shaft and limit movement thereof.

11. A sine generator drill head as claimed in claim 9, wherein said drive shaft is drivingly connected to said first gear with a ball and raceway connection.

12. A sine generator drill head as claimed in claim 11, wherein said raceway has a cross-section in the configuration of a gothic arch and said drive shaft is removed from direct contact with said first gear.

13. A sine generator drill head including an outer housing, a spindle having a first axis, said spindle being mounted to said housing for rotational and vibrational movement, a first pair of coaxial eccentric masses mounted in a sine generator housing and rotatable about a second axis, and a second pair of coaxial eccentric masses mounted in said sine generator housing and rotatable about a third axis, and a motor connected to a geared bearing race, said geared bearing race forming a part of a rotational drive system for providing said rotational movement to said spindle, and said first and second pair of eccentric masses imparting said vibrational movement upon said spindle.

14. A sine generator drill head as claimed in claim 13, wherein said spindle is moveable along its vertical axis relative to said geared bearing race.

15. A sine generator drill head as claimed in claim 13, further including at least one resilient member preloaded under a compressive force.

16. A sine generator drill head as claimed in claim 15, wherein said resilient member is a disc spring.

17. A sine generator drill head as claimed in claim 16, wherein a collar is connected to said geared bearing race said collar having a surface with radially aligned serrations, and said disc spring also has a surface having radially aligned serrations, said serrations of said collar drivingly engaging said serrations on said disc spring to transmit rotational movement from said gear bearing race to said disc spring.

18. A sine generator drill head as claimed in claim 17, further including at least one other disc spring, said first disc spring having a second surface on the side of said first disc spring opposite said first surface, said second surface also including radially aligned serrations, and said other disc spring having a surface with radially aligned serrations, said serrations on the second side of said first disc spring drivingly engaging said serrations on said surface of said other disc spring to transmit rotational movement from said first disc spring to said other disc spring and to provide alignment between said disc springs.

19. A sine generator drill head as claimed in claim 1, further including a motor providing said rotational movement of said spindle, and a resilient connection between said spindle and said housing permitting vibrational movement of the spindle relative to the housing.

20. A sine generator drill head comprising an outer housing, a spindle having an axis, a set of unevenly balanced masses rotatably mounted to a sine generator housing, a motor for causing rotation of said masses to thereby cause vibration of said spindle along the axis of the spindle, and a resilient coupling mounting said spindle for vibrational movement relative to said outer housing while substantially isolating said housing from the vibration of said unevenly balanced masses.

21. A sine generator drill head as claimed in claim 20, wherein said resilient coupling includes a bearing set mounted on said housing, a shoulder on said spindle, and at least one resilient member between the shoulder and the bearing.

22. A sine generator drill head as claimed in claim 21, wherein said resilient member includes a disc spring.

23. A sine generator drill head as claimed in claim 21, wherein said disc spring includes at least one surface having radially aligned serrations.

24. A sine generator drill head as claimed in claim 21, wherein said resilient member is preloaded under a compressive force, and a compressive force is maintained on said resilient member throughout a full vibratory cycle of said unevenly balanced masses.

25. A sine generator drill head as claimed in claim 21, wherein said resilient coupling includes an upper coupling member having a shoulder, at least one other resilient member, and at least one other bearing set mounted relative to said other resilient member, each of said resilient members extending between one of said bearings and a corresponding one of said shoulders.

26. A sine generator drill head as claimed in claim 25, further including a second motor having a pinion and a gear driven by said pinion, said gear being on a bearing race of said other bearing set and said gear being interposed between said pinion and said other resilient member.

27. A sine generator drill head as claimed in claim 20, further including a motor, a pinion driven by the motor and drivingly connected to a race of a second bearing set mounted to said drill head housing.

28. A sine generator drill head comprising an outer housing, a spindle having an axis, a vibrating mechanism for vibrating said spindle, a first motor mounted on said housing for rotating said vibrating mechanism to thereby cause vibration of said spindle, a second motor mounted on said housing for rotating the spindle about the axis thereof, and a pair of resilient couplings, said resilient couplings including resilient members maintained in a compressed state throughout a vibratory cycle of said vibrating mechanism.

29. A sine generator drill head as claimed in claim 28, further including a pinion driven by said second motor, and a geared bearing race engaged with said pinion.

30. A sine generator drill head as claimed in claim 29, wherein said resilient members includes at least one disc spring.

31. A sine generator drill head as claimed in claim 30, wherein said disc spring includes radially aligned serrations.

32. A sine generator drill head as claimed in claim 29, wherein a collar is attached to said geared bearing race and said collar positions said resilient members.

33. A sine generator drill head comprising an outer housing, a spindle having an axis, a set of eccentric masses rotatably mounted in a sine generator housing, a first drive motor mounted on said housing for causing rotation of said masses to thereby cause vibration of said spindle along the axis of the spindle, a first gear drivingly engaging said masses, a second drive motor, and a drive shaft driven by said first drive motor and drivingly engaging said first gear while permitting axial movement of said drive shaft relative to said first gear when said drive shaft is driving said first gear.

34. A sine generator drill head as claimed in claim 33, wherein said first motor drives a second gear axially offset from said first gear, said drive shaft being connected to said first gear by a first splined connection or a ball drive and to said second gear by a second splined connection whereby said drive shaft is permitted to tilt axially relative to both said first and said second gear when the masses are being driven.

35. A sine generator drill head as claimed in claim 33, wherein said drive shaft includes opposite ends, and a spring mechanism is mounted above said drive shaft provide a preload thereon and to limit movement thereof with respect to said second gear.

36. A sine generator drill head as claimed in claim 35, wherein said drive shaft is seated in a bushing having a spherical seat, and a split bushing having a spherical seat supports said drive shaft beneath said second splined connection.

37. A sine generator drill head as claimed in claim 36, wherein said split bushing is held by a snap ring fitted into a groove in said second gear.

38. A sine generator drill head comprising an outer housing, a spindle having an axis, a first motor driving a vibratory mechanism for providing vibratory movement to said spindle, a second motor for providing rotational movement to said spindle, a first gear driven by said first motor, a second gear engaging said vibratory mechanism, and a drive shaft drivingly connecting said first and second gears, said drive shaft connected to said second gear by a ball and raceway connection providing axial movement of said drive shaft relative to said second gear.

* * * * *